US006735781B1

(12) United States Patent
Fulmer

(10) Patent No.: US 6,735,781 B1
(45) Date of Patent: May 18, 2004

(54) PERSONAL HUNTING BLIND

(76) Inventor: E Wayne Fulmer, 500 N. Jefferson St., Saluda, SC (US) 29138

( * ) Notice: Subject to any disclaimer, the term of this patent is extended or adjusted under 35 U.S.C. 154(b) by 0 days.

(21) Appl. No.: 10/308,240

(22) Filed: Dec. 2, 2002

Related U.S. Application Data

(60) Provisional application No. 60/340,995, filed on Nov. 30, 2001.

(51) Int. Cl.[7] ..... A41D 3/02
(52) U.S. Cl. ..... 2/94
(58) Field of Search ..... 2/69, 69.5, 84, 2/86, 94, 456, 4, 88, 900; 135/95, 901, 905; 428/919, 15–18

(56) References Cited

U.S. PATENT DOCUMENTS 608,351 A * 8/1898 Terramorse ..... 2/89
719,899 A * 2/1903 Stacey ..... 2/89
2,911,648 A * 11/1959 Schanda-Seyferth ..... 2/69
3,160,892 A * 12/1964 Semons ..... 2/88
4,316,288 A * 2/1982 Henrickson ..... 2/88
4,484,362 A * 11/1984 Asher ..... 2/69
5,013,375 A * 5/1991 Leonard ..... 156/61
5,197,216 A * 3/1993 Norris ..... 43/1
5,274,848 A * 1/1994 Shamblin ..... 2/69
6,127,007 A * 10/2000 Cox et al. ..... 428/15
6,434,877 B1 * 8/2002 Shelton ..... 43/1
6,500,214 B1 * 12/2002 Muirhead ..... 8/478

* cited by examiner

*Primary Examiner*—Tejash Patel
(74) *Attorney, Agent, or Firm*—Michael A. Mann; Nexsen Pruet Adams Kleemeier, LLC

(57) ABSTRACT

A personal hunting blind that comprises a long sheet carrying a camouflage layer and having a head slit and two sleeves is disclosed. When the user's head passes though the head slit and the blind is carried in the shoulders, the sleeves conceal the user's arms. A head cover made of the same fabric provides concealment for the user's head. The blind is dimensioned to be long enough in the front to be draped over the ground and other surfaces proximate to the user to conceal the shape of the user. Alternatively, the blind may be tied to a tree using grommets along its back edge and provide concealment without being worn by the user.

15 Claims, 5 Drawing Sheets

PERSONAL HUNTING BLIND

This application claims the priority benefit of U.S. Provisional Application No. 60/340,995 filed on Nov. 30, 2001, which is incorporated herein by reference. provisional application.

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

It is well known that some animals have keen vision and can recognize a human being at a distance, even when the human is wearing camouflaged clothing. Also, some human beings who are trained in the art of warfare can often detect at a distance the outlines of another human being wearing camouflaged clothing. As a consequence, many hunters, photographers and soldiers prefer to use hunting blinds and avoid reliance solely on the use of camouflage outfits.

A hunting blind is an erected structure or placement constructed on location to conceal one or two people from view. It is covered with natural materials or natural-looking artificial material that allow it to blend into the surroundings. Only small openings in the blind permit the occupants to peer out in search of suitable targets.

While a hunting blind may be preferred for better concealment, it does have a significant drawback, namely, it is not portable like camouflaged clothing. Although some blinds may be taken down and reconstructed elsewhere, others are constructed in part by excavation of a portion of the terrain and inevitably must remain in place. Camouflaged clothing, on the other hand, goes with the wearer.

Thus there remains a need for a way to camouflage a hunter or a sniper that has the advantages of the greater concealment provided by a conventional hunting blind and the advantages of the easy portability of camouflaged clothing.

SUMMARY OF THE INVENTION

According to its major aspects and briefly recited, the present invention is a "personal" hunting blind, that is, it is a hunting blind dimensioned for one user and is carried on the shoulders of the user. The blind is generally in the form of an oversized poncho, oriented to hang more toward the front of the wearer, plus a head cover. The head cover doubles as a carry bag for the blind. The fabric of which the blind is made is camouflage fabric, and is most preferably fabric that includes simulated foliage and not merely a printed foliage pattern.

A feature of the present invention is that its dimensions are sufficiently generous so that it can be draped over the ground and adjacent surfaces when worn. The fact that it can be draped enables the user to conceal his shape. This feature avoids the possibility that the user will be detected by the animal or target from his shape. Even the head cover and sleeves are generous in dimensions so that they conceal the head and arms of the wearer.

Another feature of the present invention is that it is easily supported by the shoulders and head of the wearer so it can be moved when the user walks. It is thus fully portable, transportable, and reusable.

Still another feature of the present invention is the use of the head cover as a carry bag. This feature minimizes the amount of equipment that must be carried.

Another feature of the present invention is the pattern from which the personal hunting blind is made. The pattern reduces material waste and sewing operations.

These and other features and their advantages will be apparent from a careful reading of the Detailed Description of Preferred Embodiments, accompanied by the following drawings.

DETAILED DESCRIPTION OF PREFERRED EMBODIMENTS

The present invention is a personal hunting blind. The term "personal" means that it is worn and carried by the user and is intended to accommodate one person. It is also a hunting blind rather than a camouflage outfit in that, although it can be carried and supported by the shoulders of the user, it does not generally conform to the body of the wearer but, on the contrary, helps to conceal the existence of a human form behind it. It may be used for activities other than hunting; for example, it may be used for observing wildlife, photography or military purposes. There are of course other purposes for which concealment may be an advantage.

Figure 1:
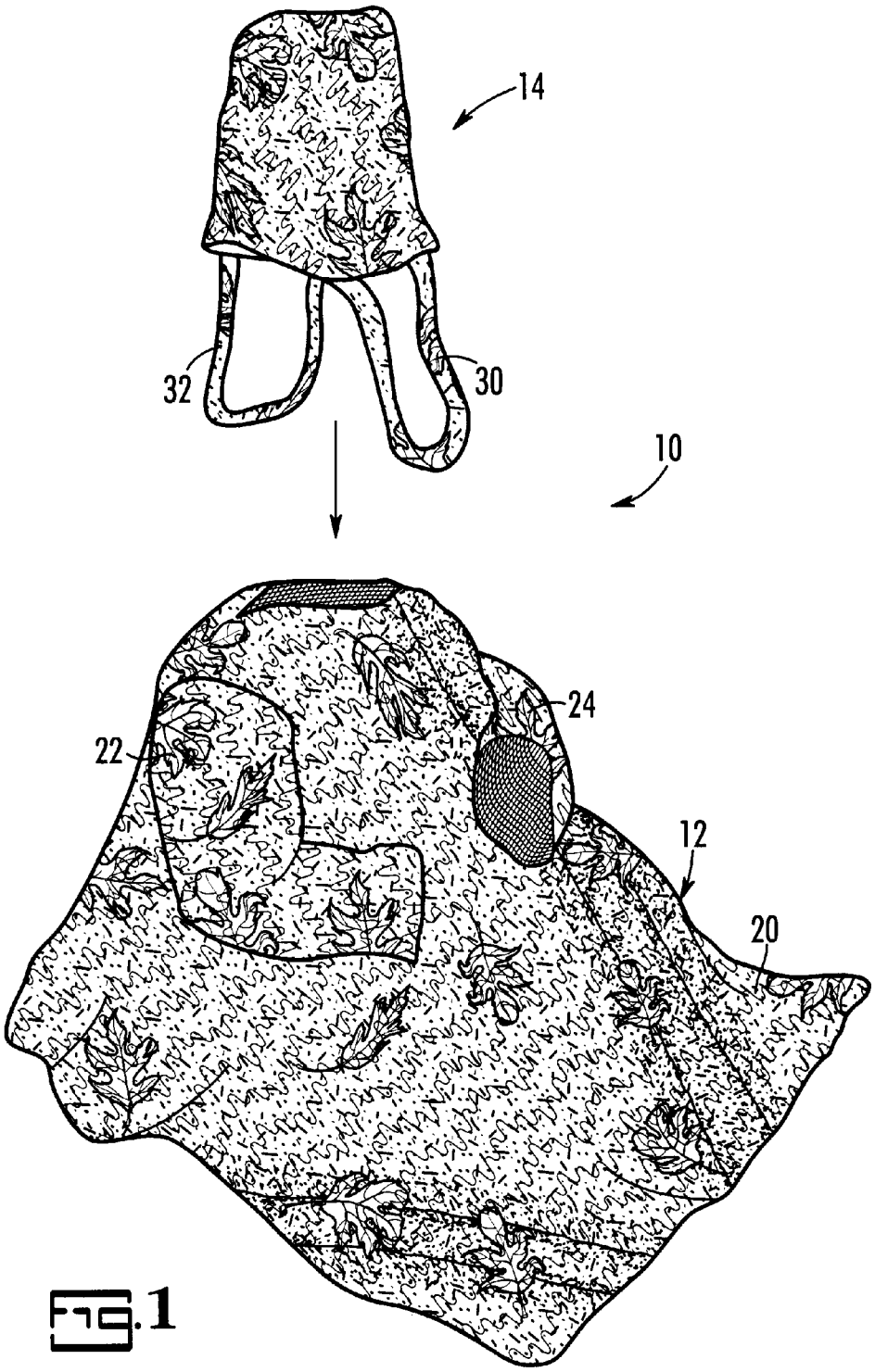
FIG. 1 is a perspective, partially exploded view of a personal hunting blind, according to a preferred embodiment of the present invention.

FIG. 1 illustrates a perspective, partially exploded view of the present hunting blind, generally indicated by reference number 10. Blind 10 has two components: a body 12 and a head cover 14. Body 12 consists of a sheet 20 of fabric and two sleeves 22, 24. Head cover 14 has at least one and preferably two carry straps 30, 32. Both body 12 and head cover 14 are preferably made of the same fabric and carry the same camouflage pattern.

The fabric of which body 12 and head cover 14 are made may be any camouflage fabric, preferably a camouflage fabric selected to simulate the environment of use, and most preferably a fabric that has a texture such as foliage-simulating structures. A suitable fabric is made by Milliken, Inc., and sold under the trademark INTRIGUE. Although other camouflage fabrics may be used for the present invention, a fabric such as INTRIGUE is most preferred because it is not merely a camouflage pattern printed onto a sheet of fabric but has features that give it a three-dimensional appearance and, importantly, is comfortable for the user when this fabric is used in the form of the present blind.

Figure 2:
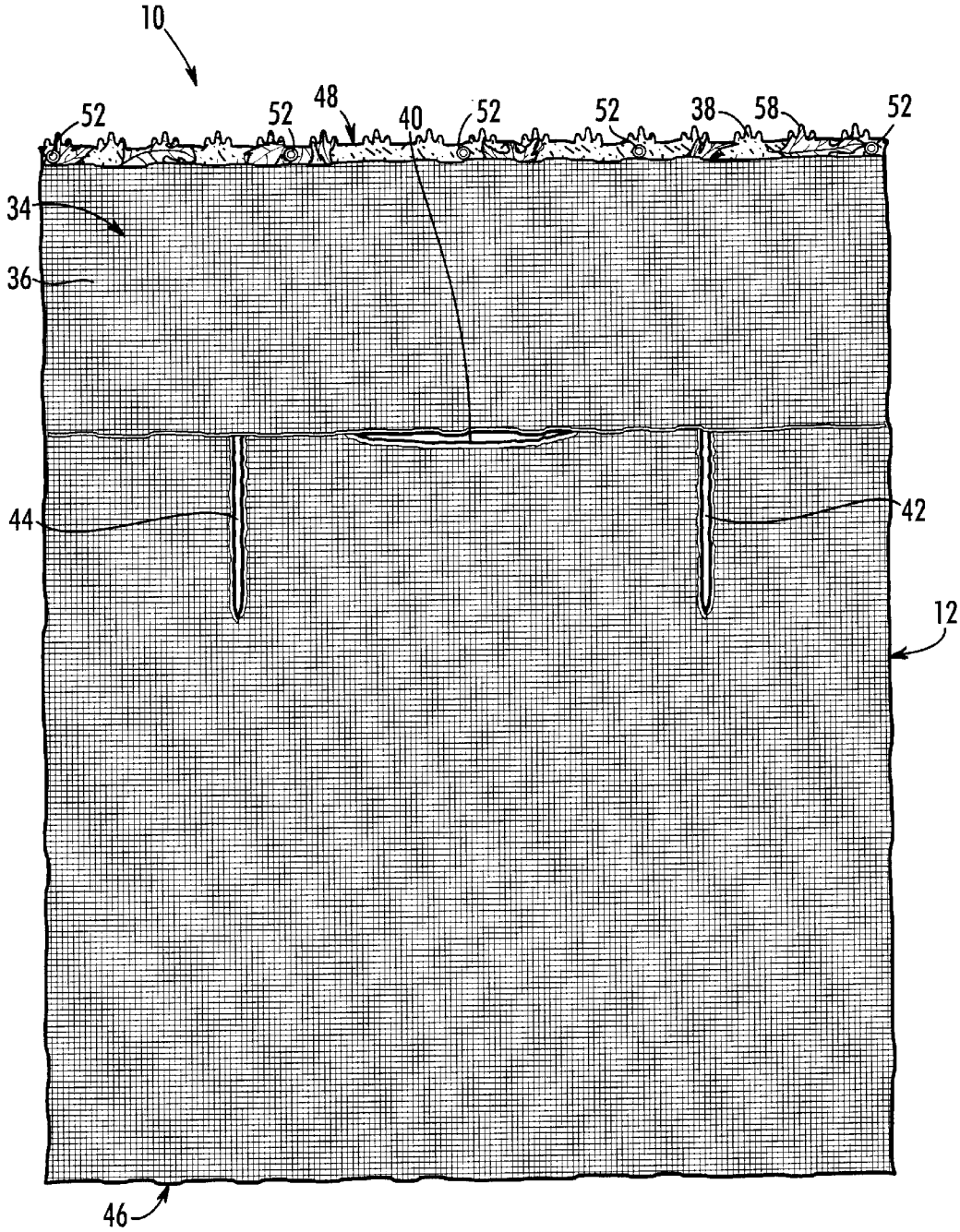
FIG. 2 is a rear view of a personal hunting blind, according to a preferred embodiment of the present invention.
Figure 3:
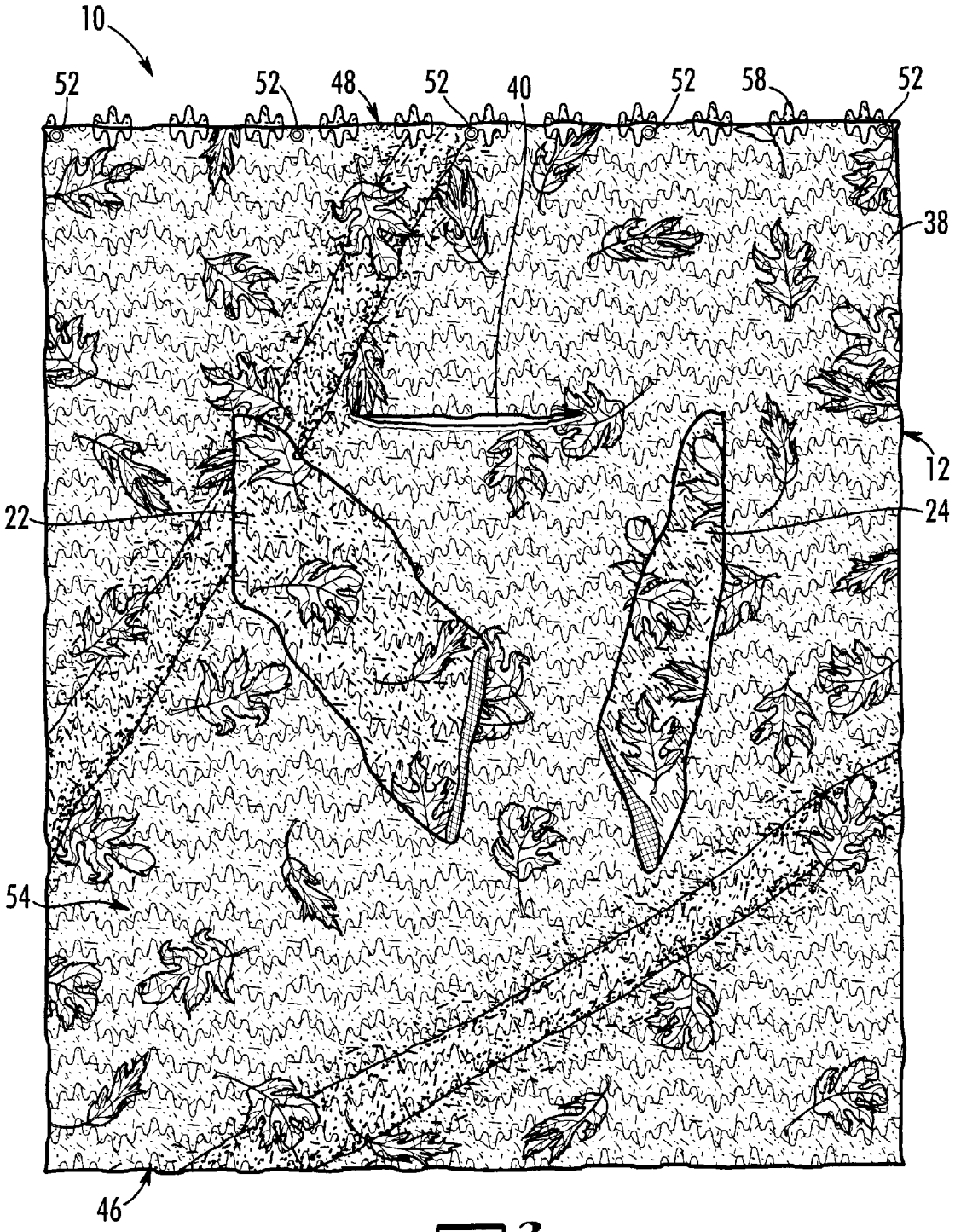
FIG. 3 is a front view of a personal hunting blind, according to a preferred embodiment of the present invention.
Figure 4:
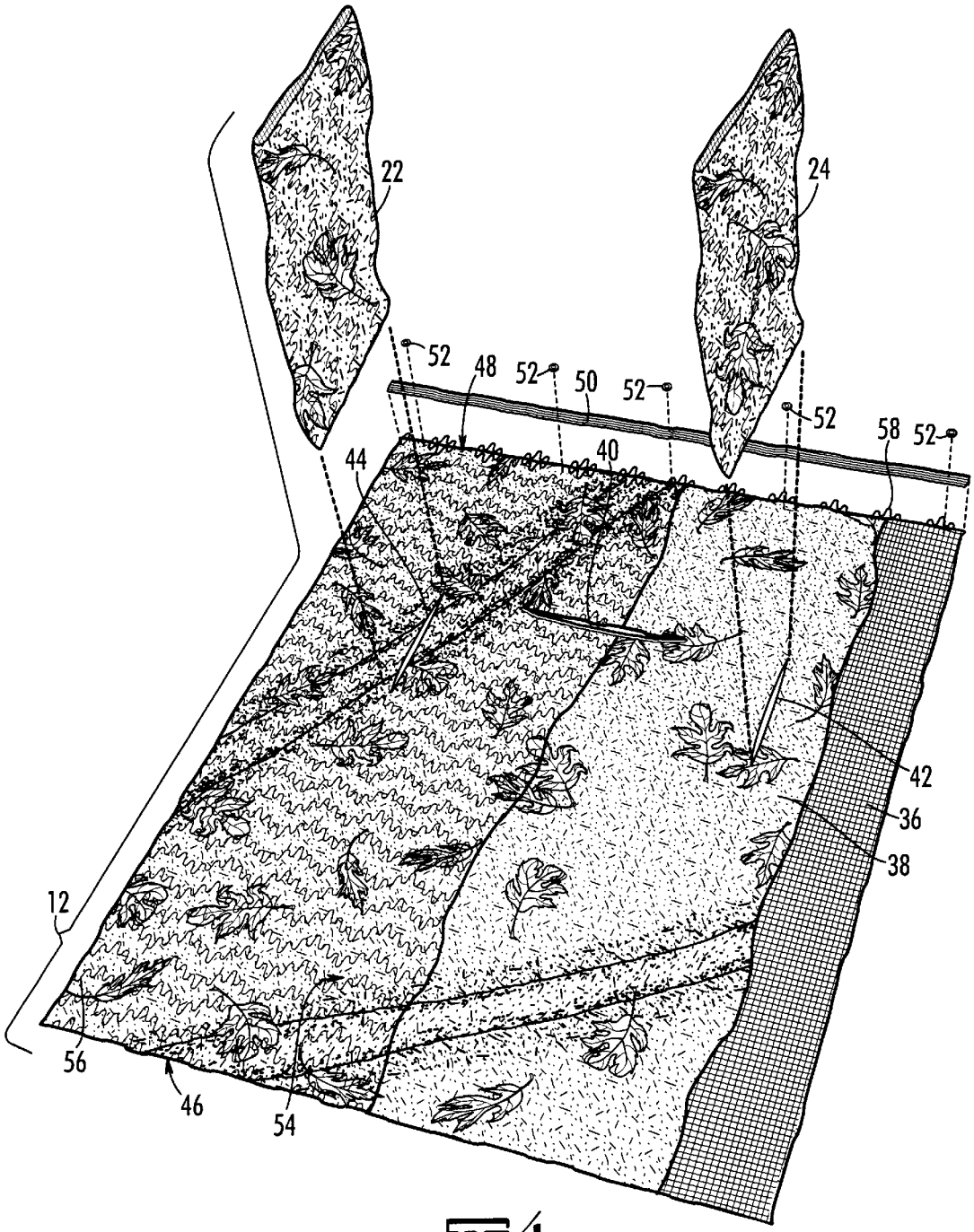
FIG. 4 is an exploded, partially cut away, perspective view of a personal hunting blind, according to a preferred embodiment of the present invention.

FIGS. 2–5 illustrate how the present blind 10 is constructed. FIG. 2 illustrates back side 34 of blind 10. Blind 10 may be in the shape of a rectangle and is made of a mesh layer 36 and a camouflage layer 38 sewn to mesh layer, as best seen in FIG. 3. It has a head slit 40, and two arm slits 42, 44 formed therein and preferably formed to provide a majority of sheet 20 to one side, namely, the portion that will hang down to the front of a wearer whose head has passed though head slit 40 and whose arms have passed through arm slits 42, 44. Thus worn, blind 10 defines a front edge 46 and a back edge 48.

Figure 5:
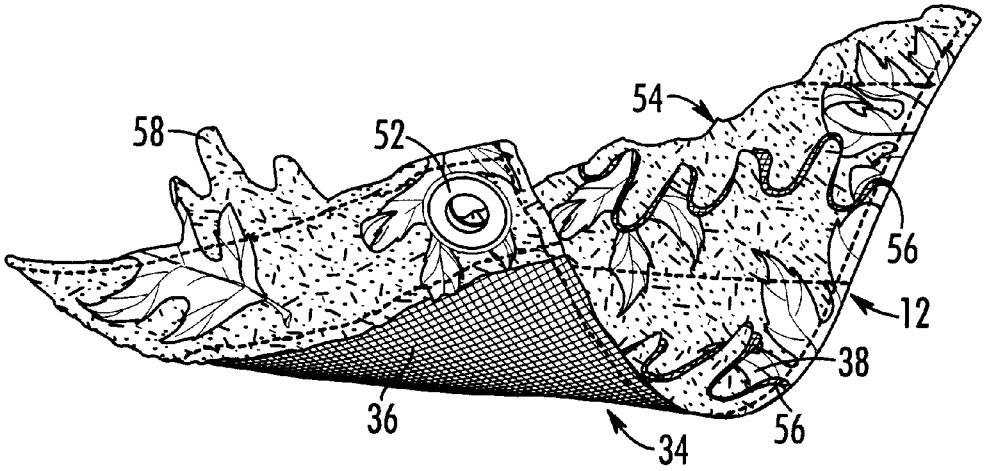
FIG. 5 is a detailed view of the fabric for a personal hunting blind according to a preferred embodiment of the present invention.

Preferably, head slit 40 is formed about ¼of the way from front edge 46 to back edge 48. A band 50 of elastic fabric is sewn into back edge 48, as best seen in FIG. 5. Plural grommets 52 are incorporated along back edge 48 to facilitate tying blind 10 to a tree, vehicle or other structure Blind 10 may be made efficiently by using two rectangular pieces of cloth. One is cut in half and one half of it cut in half again to provide fabrics for sleeves 22, 24. The other half is sewn to the second piece of cloth, leaving a portion unsewn for head slit 40. Arm slits 42, 44, are formed along the edge of the second piece of cloth lateral to head slit 40 and preferably in ¼of the way from the sides of the second piece of cloth. Sleeves 22, 24, are sewn to arm slits 42, 44 and head slit is seamed. The back edge is lapped over elastic fabric, sewn and grommetted to finish body 12. No fabric is wasted.

FIG. 3 illustrates front side 54 of blind 10. Front side 54 shows camouflage layer 38. It also carries sleeve 22 and 24. It will also be noted that there are a number of cuts 56 made in camouflage layer 38. Cuts 56 are each in the form of a double sinusoidal pattern. When sheet 20 is not flat, portions 58 of camouflage layer 38 will extend away from mesh layer 36, as best seen along back edge 48 in FIG. 3 and in FIG. 5. This extension creates a three dimensional look to blind 10 that adds to its effectiveness as concealment.

Blind 10 is preferably made large enough to allow the user to drape it over the ground and other adjacent surfaces thus providing better concealment for the human wearing it and enhancing its three dimensional presentation. This feature is important. If blind 10 is too short, it will hang on user and tend to reveal the user's shape; if too long, it becomes somewhat cumbersome to move. For an adult male of six feet in height, a length as measured from head slit 40 should be at least five feet, more or less. Thus, when a user has his head extended through head slit 40 and arms through arm slits 42, 44, front edge 46 ideally extends to the ground. Once seated on the ground, blind 10 can be draped over adjacent surfaces to conceal the user. Sleeves 22, 24 are also preferably generous so that the shape of the user's arms is concealed therein.

Head cover 14 is preferably a sewn cylinder or two rectangular portions of camouflage fabric of the same type as used for making body 12. Head cover 14 is preferably also of generous dimensions so as to be bag-like, to conceal the shape of the head of the user, and also, with straps 30 and 32, to permit use of head cover 14 as a carry bag for body 12. To facilitate viewing through head cover 14, small holes can be cut in camouflage layer 38 at locations in registration with the user's eyes to form a view port.

Blind 10 need not be worn by the user but can alternatively be draped over branches and tied using grommets 52 to a tree trunk or branches to create an uneven "wall" behind which the user can be concealed. Blind 10 can also be used to conceal objects such as deer stands, all terrain vehicles, cameras, electronic equipment and guns.

It will be clear to those skilled in the art of camouflage that many changes and substitutions can be made to the foregoing preferred embodiments without departing from the spirit and scope of the present invention, which is defined by the appended claims.

What is claimed is:

1. A device for use by a hunter, said device comprising:

a sheet made of fabric and having a hole formed therein dimensioned to allow the head of a hunter to pass therethrough so that said sheet can be supported by the shoulders of said hunter, draping on the ground when so worn, said sheet concealing the shape of the front of said hunter, said fabric carrying camouflage, wherein said sheet has a front edge and a back edge, said back edge having an elastic fabric fastened thereto; and a bag made of said fabric dimensioned to fit over the head of said hunter and rest on said shoulders of said hunter when worn, said bag having a view port located so as to be in registration with the eyes of said hunter when worn on the head of said hunter.

2. The device as recited in claim 1, wherein said sheet has two armholes formed therein and further comprising a pair of sleeves, each sleeve attached to said sheet at one armhole of said two armholes.

3. The device as recited in clam 1, wherein said elastic fabric is fitted with grommets.

4. The device as recited in claim 1, wherein said sheet is in the shape of a rectangle.

5. The device as recited in claim 1, wherein said fabric further comprises a mesh fabric to which is attached simulated foliage.

6. The device as recited in claim 1, wherein said bag has at least one carry strap.

7. The device as recited in claim 1, wherein said hole is formed one quarter of the way between said back edge and said front edge.

8. The device as recited in claim 1, wherein said sheet is dimensioned so that, when worn on the shoulders of a standing hunter, said front edge reaches the ground.

9. A device for use by a hunter, said device comprising:

a sheet made of camouflage fabric adapted to be supported on the shoulders, said sheet dimensioned to extend far enough below the shoulders of said hunter so that said sheet may spread over the ground and onto adjacent surfaces whereby the shape of said hunter is concealed behind said sheet, said sheet having a front edge and a back edge, and wherein said back edge carries an elastic fabric.

10. The device as recited in claim 9, wherein said edge plural grommets fastened therein.

11. The device as recited in claim 9, wherein said camouflage fabric further comprises a mesh fabric to which is attached simulated foliage.

12. A method of making a hunting blind for a hunter, said method comprising the steps of:

providing a sheet of camouflage fabric, said sheet having an edge;

attaching a length of elastic fabric to said edge;

forming a hole dimensioned for the head of a hunter to pass therethrough near said edge; and forming a bag of said camouflage fabric dimensioned to cover the head and neck of said hunter;

positioning said sheet on the shoulders of said hunter, said head of said hunter being passed through said hole of said sheet with said edge of said sheet oriented toward the back of said hunter;

placing said bag over said head of said hunter; and draping said sheet over the ground and surrounding surfaces to conceal the shape of said hunter.

13. The method as recited in claim 12, further comprising the step of attaching grommets to said elastic fabric.

14. The method as recited in claim 12, further comprising the step of attaching carrying straps to said bag.

15. The method as recited in claim 12, further comprising the step of forming a view port in said bag.

* * * * *